US005460463A

United States Patent [19]

Smith

[11] Patent Number: 5,460,463

[45] Date of Patent: Oct. 24, 1995

[54] METHOD FOR PROTECTING MARINE PILINGS

[75] Inventor: Jerry B. Smith, Bellingham, Wash.

[73] Assignee: Atlantic Richfield Company, Los Angeles, Calif.

[21] Appl. No.: 189,775

[22] Filed: Feb. 1, 1994

[51] Int. Cl.[6] ..... F02B 3/20

[52] U.S. Cl. ..... 405/212; 405/216

[58] Field of Search ..... 405/195.1, 211, 405/211.1, 212, 216

[56] References Cited

U.S. PATENT DOCUMENTS

| | | | |
|---|---|---|---|
| 2,928,411 | 3/1960 | Johnson | 405/216 X |
| 3,181,300 | 5/1965 | Plummer | 405/216 |
| 3,524,231 | 8/1970 | Wiswell | 405/216 X |
| 3,999,399 | 12/1976 | Maurer | 405/216 X |

*Primary Examiner*—David H. Corbin
*Attorney, Agent, or Firm*—F. Lindsey Scott

[57] ABSTRACT

A method for protecting marine pilings positioned to support a marine structure above the water wherein a plurality of pilings are positioned to support the marine structure. The method consisting essentially of positioning a fender over exposed surfaces of a protective coating on the pilings through the splash zone; and retaining the fender in position.

5 Claims, 2 Drawing Sheets

METHOD FOR PROTECTING MARINE PILINGS

BACKGROUND OF THE INVENTION

1. Field of the Invention

This invention relates to a method for protecting marine pilings positioned to support a marine structure above the water in areas where floating booms, bumpers and the like are in contact with the marine pilings.

2. Background

In the construction of docks, piers and the like, pilings are frequently used to support marine structures. Generally, the pilings are positioned around the outer perimeter of the marine structures to support the structures above the water. Normally a plurality of pilings are used. Frequently these pilings are large metal pipe which has been driven to a suitable depth in the ocean floor to support a marine structure.

The pipe is frequently cathodically protected below the water line as known to those skilled in the art. Protective coatings may be used in addition to the cathodic protection. Cathodic protection can be used to protect such pilings below the water level whether or not protective coatings are used.

A different problem arises in the wet areas above the low tide water level. These areas (referred to herein as the splash zone) include the area of the pilings intermittently wet by the water as the tides rise and fall and the area above the then-current water level which is wet by splashes, wave action and the like. While cathodic protection is effective to protect such pilings beneath the water level, it is not effective to protect the splash zone of the pilings. Accordingly, the effectiveness of the protective coating becomes crucial in the splash zone. Coatings such as coal tar epoxy resins have been used effectively to protect pilings, but are susceptible to abrasion, chipping and other damage as a result of contact with sharp objects. In many instances, pilings are used to support structures which are used to load or unload ships containing crude oil or other materials which it is undesirable to spill into the ocean. In such instances floating booms are used to surround the ship during loading or unloading operations so that oil spills or other similar material spills may be contained and recovered effectively. Such floating booms frequently come into contact with the pilings and, since such booms are generally relatively substantial structures, this contact with the pilings results in chipping, scratching, tearing and otherwise damaging the protective coating. Bumpers used to position ships may also come into contact with and damage the protective coating.

In an attempt to resolve this problem, different protective coatings have been used. One recently used protective coating comprises grease covered with a protective tape which is then covered by a relatively heavy, high-density polyethylene sheet. While this protective coating is effective, it is also vulnerable to damage from floating booms and the like.

Since the construction of such pilings and marine structures is relatively expensive, it is highly desirable that an effective method be found to protect such pilings against corrosion in the wet area.

SUMMARY OF THE INVENTION

According to the present invention, a method is provided for protecting marine pilings positioned to support a marine structure above the water when a plurality of said pilings are positioned to support the marine structure. The method consists essentially of positioning fenders over exposed surfaces of a protective coating on the pilings through the splash zone and retaining the fenders in position.

DESCRIPTION OF PREFERRED EMBODIMENTS

In the discussion of the Figures, the same numbers will be used to refer to the same or similar components throughout the discussion.

Figure 1:
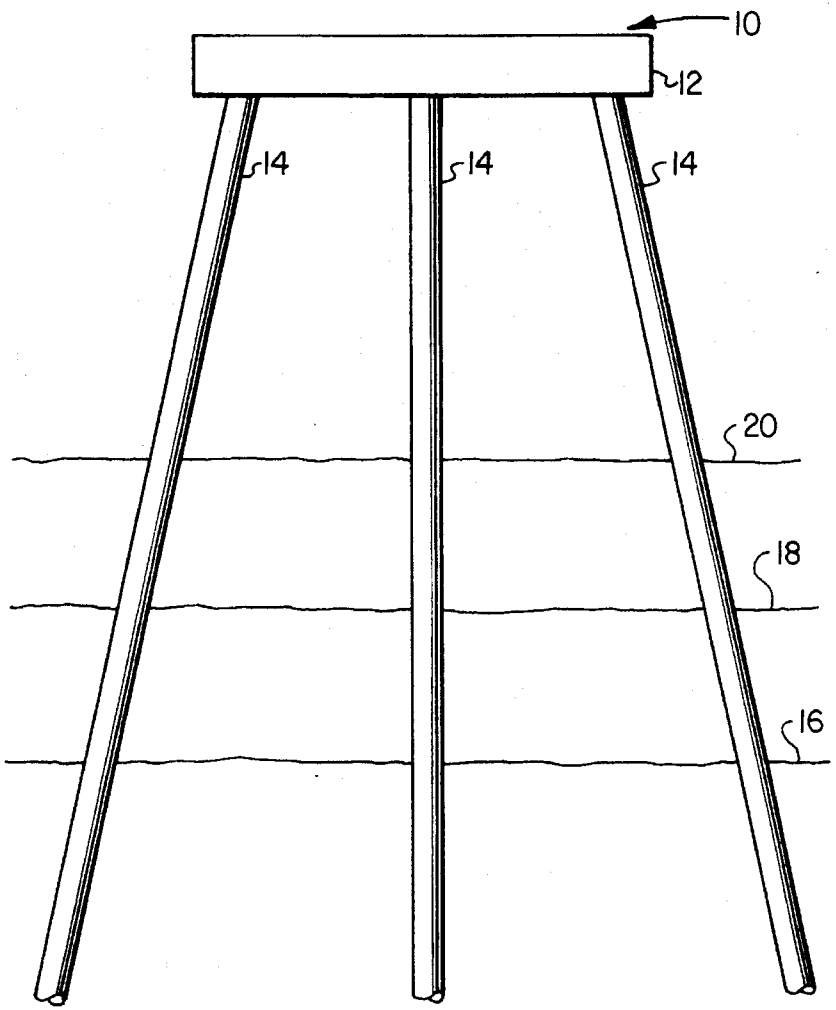
FIG. 1 (PRIOR ART)
FIG. 1 is a schematic diagram of a prior art marine structure supported by pilings in a marine environment.

In FIG. 1, a marine structure 10 comprising a platform area 12 which may be a dock, loading or unloading platform or the like, is supported in a marine environment by a plurality of pilings 14. Pilings 14 extend into the sea floor (not shown) for a substantial distance as necessary to support surface 12. Pilings 14 generally comprise steel pipe which has been driven into the ocean floor and as shown in FIG. 1 are positioned in the ocean. A low tide water level 16, a high tide water level 18 and a zone wet by wave action, splashes, etc. extending above high tide water level 18 and up to the line 20 are shown. The area above low tide water level 16 and up to line 20 are referred to herein as the splash zone. In such platforms, it is desirable to protect the exposed surfaces of the pilings in the areas above the low tide water level (splash zone) since cathodic protection is not effective above the water. The term "exposed surfaces" refers to the outer 180° to 300° of the circumference of the piling surface facing toward the outside of the supported structure.

Figure 2:
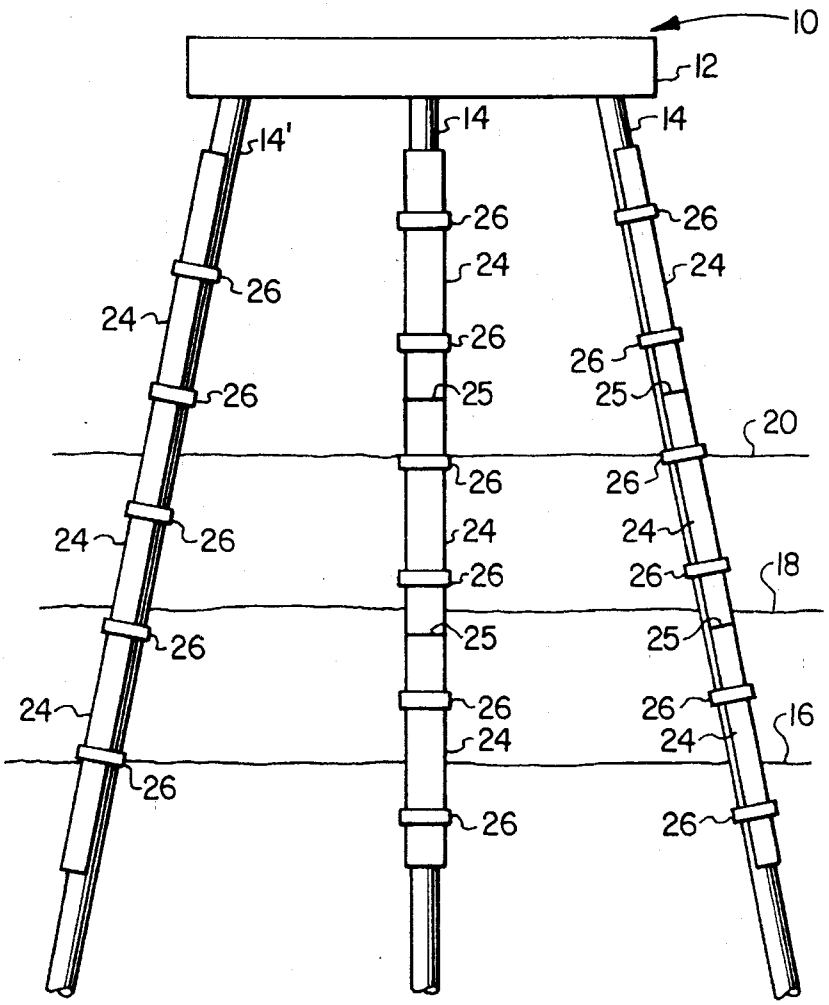
FIG. 2 is a schematic diagram of a marine structure supported by pilings in a marine environment wherein fenders are positioned on the pilings.

In FIG. 2, the structure of FIG. 1 is shown with fenders 24 according to the present invention in place on pilings 14. Three fenders 24 are shown on each piling. It should be understood that fewer or more fenders could be used depending upon the sizing of the fenders, ease of installation and the like. Fenders 24, as shown, are maintained in position on a pilings 14 by two straps 26 each. Fenders 24 are maintained in position, as shown, on piling 14' by one strap 26 in the middle of each fender 24 plus a strap 26 over each junction 25 between fenders 24. Fewer or more straps per fender or other strap positionings could be used.

Figure 3:
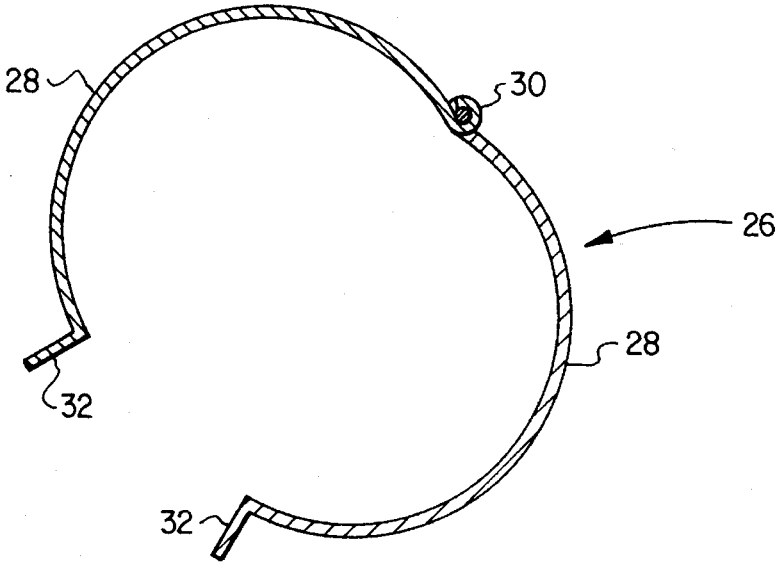
FIG. 3 is a cross-sectional view of an embodiment of a strap.
Figure 4:
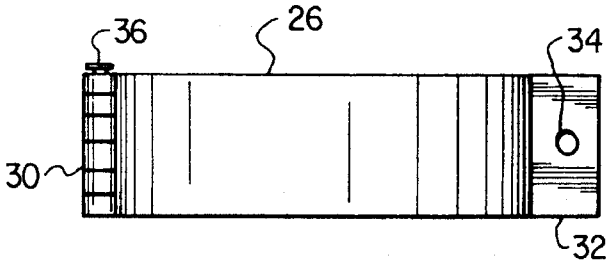
FIG. 4 is a side view of the strap shown in FIG. 3.

In FIG. 3, a cross-sectional view of a strap 26 is shown. Strap 26 comprises two sections 28 which are curved to conform generally to the outer circumference of pilings 14. Sections 28 are joined along one of their ends by a hinge 30 which may be of any suitable type. Hinge 30, as shown in FIG. 4, comprises a plurality of passageways positioned on the strap ends and adapted to matingly join so that when the passageways on sections 28 are aligned, a pin 36 (shown in FIG. 4) can be placed through said passageways to hingedly join sections 28 as shown. As noted, other types of hinges could be used. Straps 26, as shown in FIG. 3, are effective to maintain fenders 24 in position on pilings 14. Straps 26 comprise sections 28 adapted to be positioned on the outside of a fender 24 to retain the fender in position on a piling 14. Sections 26 terminate in flanges 32 which contain at least one bolthole 34 (shown in FIG. 4) to receive a bolt 40, shown in FIG. 7, which, when tightened, brings sections 28 into close engagement with the outside of a fender 24 to maintain fender 24 in position on a piling 14. One-eighth inch steel has been found to be a suitable material for the construction of sections 28 and fenders 24.

FIG. 4 is a side view of a strap 26 and more clearly shows hinge 30, flange 32 and bolthole 34.

Figure 5:
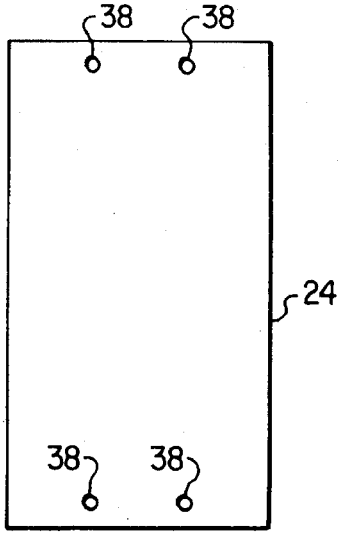
FIG. 5 is a side view of an embodiment of a fender.

FIG. 5 is a side view of a fender 24. Fender 24 includes holes 38 on each end for use in handling fender 24 during installation, etc. It is desired that fender 24 be positioned to cover only the exposed portions of each piling 14. In other words, the portions of the piling facing outwardly from structure 10 are exposed to contact with objects which can damage the protective coating. Such objects rarely, if ever, intrude within the area enclosed by the pilings to the extent necessary to damage the protective coating on the back side of the piling. It is desired that the fender be sized and positioned to cover at least 180° of the outer surface of the protective coating (not shown) around the piling and up to as much as 300° of the outer surface of the protective coating around the piling, as shown in FIG. 7.

Figure 6:
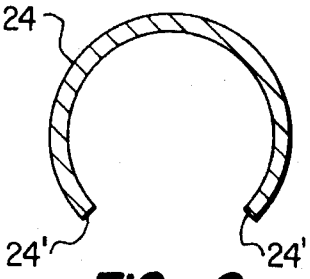
FIG. 6 is a cross-sectional end view of the fender shown in FIG. 5.

FIG. 6 is a cross-sectional view of the fender shown in FIG. 5. Fender 24 is desirably formed to have a radius of curvature which is generally the same as the outer diameter of piling 14. Preferably the curvature of fender 24 is limited so that ends 24' are spaced apart to permit fender 24 to be positioned on piling 14 with limited or no deformation of fender 24. Fender 24 is retained in position on piling 14 by straps 26.

Figure 7:
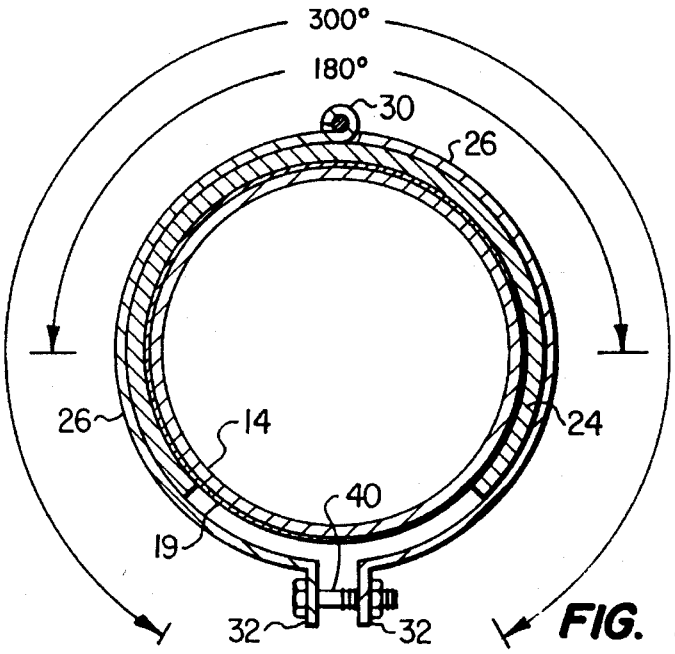
FIG. 7 is a cross-sectional view of a fender and a strap installed on a piling.

As shown in FIG. 7, fender 24 is positioned on a piling 14 to cover the exposed surfaces (i.e. the surfaces of the piling facing generally toward the outside of the supported structure) of the protective coating on the piling. Fender 24 is maintained in position by straps 26, as shown. It is highly desirable that fender 24 does not extend completely around piling 14. When embodiments of fender 24 which extended fully around piling 14 were used, it was found that, when fender 24 is joined or overlaps, it is very difficult to remove the fender for replacement. It is contemplated that fender 24 will be damaged, corroded or the like sufficiently to warrant replacement relatively frequently and, since fender 24 is relatively inexpensive, this replacement can be done economically while accomplishing a great improvement in the protection to pilings 14. Fenders 24 on pilings 14 in FIG. 2 do not extend all the way around pilings 14. Neither does fender 24 on center piling 14 but, in the view shown, it is not apparent that fender 24 does not extend all the way around center piling 14.

By the practice of the present method, dependable protection against cuts, abrasion and the like damage to protective coatings on pilings 14 is achieved. While fenders 24 may be damaged and may require replacement for a variety of reasons, they are economically and easily replaced.

A variety of protective coatings, as indicated for example by reference numeral 19 on FIG. 7, may be used on pilings 14. One such coating comprises a corrosion-inhibiting protective coating consisting of a layer of grease which is wrapped in a tape and finally covered by a high-density polyethylene sheet. Another suitable protective coating is coal tar epoxy resins. It is contemplated that fenders 24 will be effective when positioned over all such protective coatings.

Fender 24 may consist of any suitable metal or plastic material which has sufficient strength as formed to provide protection to the protective coating around piling 14.

It is necessary that fender 24 be positioned to extend from above the top of the splash zone to below the low tide water level 16. This ensures protection for wet areas which are not dependably protected by cathodic protection. Fenders 24 may be of any length suitable for convenient handling and installation on pilings 14. While three fenders have been shown in FIG. 2, fewer or more could be used. The use of a plurality of fenders 24 allows for the replacement of less than all the fenders if desired due to different damage or corrosion to fenders at different positions, different levels or the like.

Having thus described the invention by reference to certain of its preferred embodiments, it is respectfully pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

Having thus described the invention, I claim:

1. A method for protecting metal marine pilings which are generally cylindrical in shape and have an exposed outer surface thereon said pilings positioned to support a marine structure above the water wherein a plurality of said pilings are positioned to support said marine structure, said method consisting essentially of:

a) positioning a fender over the exposed surface of said pilings, said fender facing outwardly from said marine structure and extending from above a low water line and through a splash zone on said piling such that from about 180° to about 300° of the outer surface of said piling is covered by said fender, the fender having a radius of curvature which essentially corresponds to the corresponding radius of curvature for the outer surface of said piling; and, b) retaining said fender in position by a plurality of straps which are positioned around said fender and said piling.

2. The method of claim 1 wherein said pilings are coated with a protective coating above the low water line and through the splash zone, said protective coating being effective to protect against corrosion of said pilings,

3. The method of claim 2 wherein said protective coating comprises a grease covered by a protective tape and an outer covering of a high-density polyethylene sheet.

4. The method of claim 2, wherein said protective coating is a coal tar epoxy coating.

5. The method of claim 2 wherein said fender is positioned over said protective coating.

* * * * *